US010422064B2

(12) United States Patent
Seong et al.

(10) Patent No.: US 10,422,064 B2
(45) Date of Patent: Sep. 24, 2019

(54) WASHING APPARATUS AND CONTROL METHOD FOR THE SAME

(71) Applicant: SAMSUNG ELECTRONICS CO., LTD., Suwon-si, Gyeonggi-do (KR)

(72) Inventors: Su Jin Seong, Suwon-si (KR); Hyun Sook Kim, Hwaseong-si (KR); Woo Kyung Jung, Suwon-si (KR); Ja Yeon Seo, Suwon-si (KR); Seung-Mok Lee, Suwon-si (KR); Yu Ri Lee, Yongin-si (KR); Jong Ho Lee, Yongin-si (KR); Yong Mi Jung, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 81 days.

(21) Appl. No.: 15/436,101

(22) Filed: Feb. 17, 2017

(65) Prior Publication Data

US 2017/0241060 A1 Aug. 24, 2017

(30) Foreign Application Priority Data

Feb. 23, 2016 (KR) ..... 10-2016-0021157

(51) Int. Cl.
*D06F 33/02* (2006.01)
*D06F 39/14* (2006.01)
(Continued)

(52) U.S. Cl.
CPC ..... *D06F 33/02* (2013.01); *D06F 23/06* (2013.01); *D06F 37/22* (2013.01); *D06F 37/304* (2013.01);
(Continued)

(58) Field of Classification Search
CPC ..... D06F 23/02; D06F 23/06; D06F 33/02; D06F 37/266; D06F 37/28; D06F 39/005; D06F 39/083; D06F 39/088; D06F 39/14
See application file for complete search history.

(56) References Cited

U.S. PATENT DOCUMENTS 7,490,491 B2 * 2/2009 Yang ..... D06F 35/006 68/12.05
2007/0295037 A1 * 12/2007 Blomberg ..... D06F 37/28 68/17 R
(Continued)

FOREIGN PATENT DOCUMENTS

EP 2 104 761 A2 9/2009
EP 2 796 607 A1 10/2014
(Continued)

*Primary Examiner* — Joseph L. Perrin
(74) *Attorney, Agent, or Firm* — Staas & Halsey LLP

(57) ABSTRACT

A washing apparatus and control method where the washing apparatus comprises a door configured to open and close the entrance; a tub inside a main body; a diaphragm configured to connect the entrance with the opening; and a drum rotatably provided inside the tub. The washing apparatus includes a door washing nozzle to inject water for a first time in a first section and then to inject the water for a second time in a second section when a washing mode of the diaphragm is entered. The washing mode of the diaphragm including the first section in which the drum in a stopped state is accelerated to arrive at a first target rotation speed less than a second target rotation speed and the second section in which the drum at the first target rotation speed is accelerated to arrive at the second target rotation speed.

9 Claims, 11 Drawing Sheets

(51) Int. Cl.

| | |
|---|---|
| ***D06F 23/06*** | (2006.01) |
| ***D06F 37/22*** | (2006.01) |
| ***D06F 37/30*** | (2006.01) |
| ***D06F 37/36*** | (2006.01) |
| ***D06F 39/00*** | (2006.01) |
| ***D06F 39/02*** | (2006.01) |
| ***D06F 39/08*** | (2006.01) |

(52) U.S. Cl.
CPC ..... *D06F 37/36* (2013.01); *D06F 39/005* (2013.01); *D06F 39/02* (2013.01); *D06F 39/085* (2013.01); *D06F 39/088* (2013.01); *D06F 39/14* (2013.01)

(56) References Cited

U.S. PATENT DOCUMENTS

2009/0249838 A1* 10/2009 Kim ..... D06F 39/088 68/58
2009/0249840 A1* 10/2009 Jo ..... D06F 39/008 68/5 C
2010/0205753 A1* 8/2010 Kim ..... D06F 39/083 8/137
2011/0083477 A1* 4/2011 Kim ..... D06F 37/266 68/140
2011/0099727 A1* 5/2011 Kim ..... D06F 35/006 8/137
2011/0146004 A1* 6/2011 Kim ..... D06F 33/02 8/137
2013/0145562 A1* 6/2013 Lee ..... D06F 39/088 8/137
2014/0299164 A1* 10/2014 Zhang ..... D06F 39/088 134/34
2014/0326025 A1* 11/2014 Im ..... D06F 39/08 68/139

FOREIGN PATENT DOCUMENTS

KR 10-0662437 1/2007
KR 10-2011-0040180 4/2011

* cited by examiner

WASHING APPARATUS AND CONTROL METHOD FOR THE SAME

CROSS-REFERENCE TO RELATED APPLICATION

This application claims the benefit of Korean Patent Application No. 10-2016-0021157, filed on Feb. 23, 2016 in the Korean Intellectual Property Office, the disclosure of which is incorporated herein by reference.

BACKGROUND

1. Field

Embodiments of the present invention relate to a washing apparatus and a control method for the same.

2. Description of the Related Art

In general, a washing apparatus is a home appliance which washes clothes using electric power. The washing apparatus may be classified into a drum type washing apparatus in which laundry is washed by lifting up and then dropping the laundry while a rotating tub is rotated and a motor operated washing apparatus in which the laundry is washed using a water stream generated by a pulsator when the rotating tub is rotated.

The drum type washing apparatus may include a main body forming an exterior, a tub provided inside the main body and in which washing water is supplied, and a drum rotatably provided in the tub. Also, the drum type washing apparatus may further include a diaphragm for connecting an entrance of the tub with an opening of the main body.

The diaphragm may prevent water from leaking into the main body through the entrance of the tub and may also reduce vibration generated by rotation of the drum from being transmitted to the main body. To this end, the diaphragm may include a buffer provided to be bent.

SUMMARY

Therefore, it is an aspect of the present invention to provide a washing apparatus for washing a diaphragm by providing a force due to an air flow generated by rotation of a drum to washing water, and a control method for the same.

Additional aspects of the invention will be set forth in part in the description which follows and, in part, will be obvious from the description, or may be learned by practice of the invention.

In accordance with one aspect of the present invention, there is provided a washing apparatus including a main body having an entrance provided at a front side thereof; a door configured to open and close the entrance; a tub having an opening corresponding to the entrance and provided inside the main body; a diaphragm configured to connect the entrance with the opening; a drum rotatably provided inside the tub; a door washing nozzle provided on the diaphragm to inject washing water to the door; and a controller configured to control the door washing nozzle to inject the washing water for a first time in a first section and then to inject the washing water for a second time in a second section when a washing mode of the diaphragm including the first section at which the drum in a stopped state arrives at a first target rotation speed and the second section at which the drum rotated at the first target rotation speed arrives at a second target rotation speed is entered.

The diaphragm may include a buffer provided to be bent and thus to reduce vibration generated by rotation of the drum from being transmitted to the main body, and the controller controls the door washing nozzle to provide the washing water to the buffer of the diaphragm.

The washing apparatus may further include a washing reinforcement nozzle provided on the diaphragm to inject the washing water into the drum, wherein the controller may control the washing reinforcement nozzle to inject the washing water when the door washing nozzle injects the washing water.

The washing apparatus may further include a water supply pipe configured to simultaneously supply the washing water to the door washing nozzle and the washing reinforcement nozzle, wherein the controller may control opening and closing of the water supply pipe so that the washing water supplied through the water supply pipe is injected through the door washing nozzle and the washing reinforcement nozzle.

The controller may control the drum to be rotated with a first rotational acceleration in the first section and then to be rotated with a second rotational acceleration in the second section when the washing mode of the diaphragm is entered.

The controller may control the drum to be constantly rotated for a third time when the drum arrives at the first target rotation speed.

The washing apparatus may further include an input part configured to receive a command for entering the washing mode of the diaphragm.

The controller may enter the washing mode of the diaphragm when the washing apparatus performs at least one of a rinsing stroke and a spin-drying stroke.

The controller may control the door washing nozzle to inject the washing water for the first time when the drum is rotated at 300 RPM or more in the first section.

According to an aspect of another exemplary embodiment, there is a washing apparatus including a main body having an entrance provided at a front side thereof; a tub having an opening corresponding to the entrance and provided inside the main body; a drum rotatably provided inside the tub; a diaphragm having a buffer provided to be bent to reduce vibration generated by rotation of the drum and configured to connect the entrance with the opening; a diaphragm washing nozzle provided at a position corresponding to a rotational direction of the drum to inject washing water to the diaphragm; and a controller configured to control the diaphragm washing nozzle to inject the washing water in the rotational direction of the drum while the drum is rotated.

The diaphragm washing nozzle may be provided at a left side based on a center of an upper portion of the diaphragm when the drum is rotated clockwise and also provided at a right side based on the center of the upper portion of the diaphragm when the drum is rotated counterclockwise.

The controller may control the diaphragm washing nozzle to inject the washing water for a first time in a first section and then to inject the washing water for a second time in a second section when a washing mode of the diaphragm including the first section at which the drum in a stopped state arrives at a first target rotation speed and the second section at which the drum rotated at the first target rotation speed arrives at a second target rotation speed is entered.

The washing apparatus may further include a washing reinforcement nozzle provided on the diaphragm to inject the washing water into the drum, wherein the controller may control the door washing nozzle to inject the washing water when the diaphragm washing nozzle injects the washing water.

The washing apparatus may further include a water supply pipe configured to simultaneously supply the washing water from an outside to the diaphragm washing nozzle and the washing reinforcement nozzle, wherein the controller may control opening and closing of the water supply pipe so that the washing water supplied through the water supply pipe is injected through the diaphragm washing nozzle and the washing reinforcement nozzle.

The controller may control the diaphragm washing nozzle to inject the washing water for a predetermined time while the drum is rotated at 300 RPM or more.

According to an aspect of another exemplary embodiment, there is a method for controlling a washing apparatus which comprises a diaphragm configured to connect an entrance of a main body with an opening of a tub and a door washing nozzle provided on the diaphragm to inject washing water to a door for opening and closing the entrance, the method including acceleratedly rotating a drum in a stopped state inside the tub to arrive at a first target rotation speed when a first section in a washing mode of the diaphragm is entered; injecting the washing water from the door washing nozzle for a first time in the first section; acceleratedly rotating the drum rotated at the first target rotation speed to arrive at a second target rotation speed when a second section in the washing mode of the diaphragm is entered; and injecting the washing water from the door washing nozzle for a second time in the second section.

The injecting of the washing water from the door washing nozzle for the first time in the first section and the injecting of the washing water from the door washing nozzle for the second time in the second section may include injecting the washing water from a washing reinforcement nozzle which is provided on the diaphragm to inject the washing water into the drum when the door washing nozzle injects the washing water.

The injecting of the washing water from the door washing nozzle for the first time in the first section may further include opening a water supply pipe for simultaneously supplying the washing water to the door washing nozzle and the washing reinforcement nozzle for the first time in the first section, and the injecting of the washing water from the door washing nozzle for the second time in the second section further includes opening the water supply pipe for the second time in the second section.

The method may further include receiving an input of a command for entering the washing mode of the diaphragm, wherein the acceleratedly rotating of the drum in the stopped state inside the tub to arrive at the first target rotation speed may include entering the first section in the washing mode of the diaphragm when the command for entering the washing mode of the diaphragm is input.

The acceleratedly rotating of the drum in the stopped state inside the tub to arrive at the first target rotation speed may include entering the first section in the washing mode of the diaphragm when at least one of a rinsing stroke and a spin-drying stroke of the washing apparatus is performed.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Hereinafter, a washing apparatus and a control method for the same will be described in detail with reference to the accompanying drawings.

Figure 1:
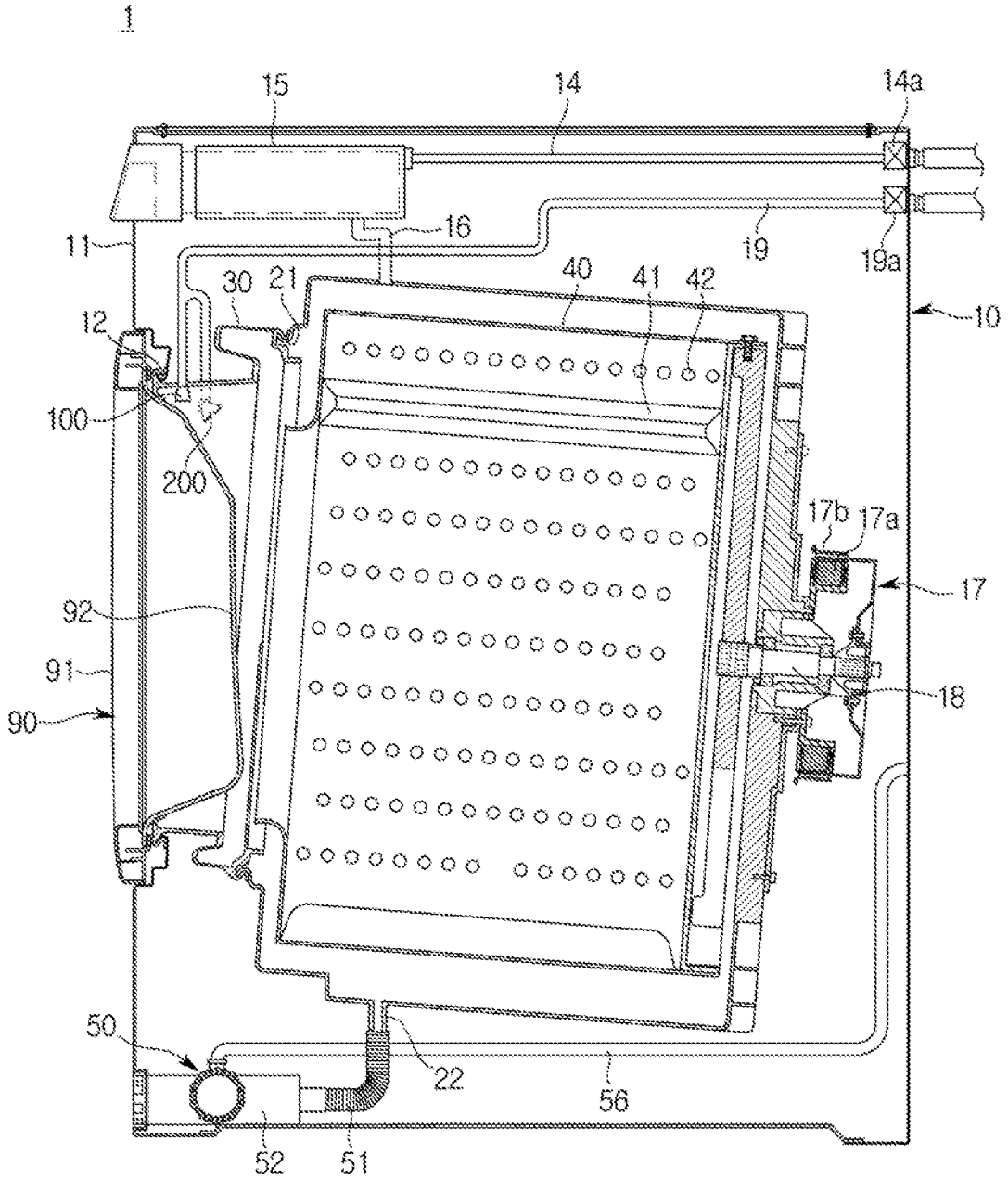
FIG. 1 is a side cross-sectional view illustrating a schematic configuration of a washing apparatus according to one embodiment of the present invention.
Figure 2:
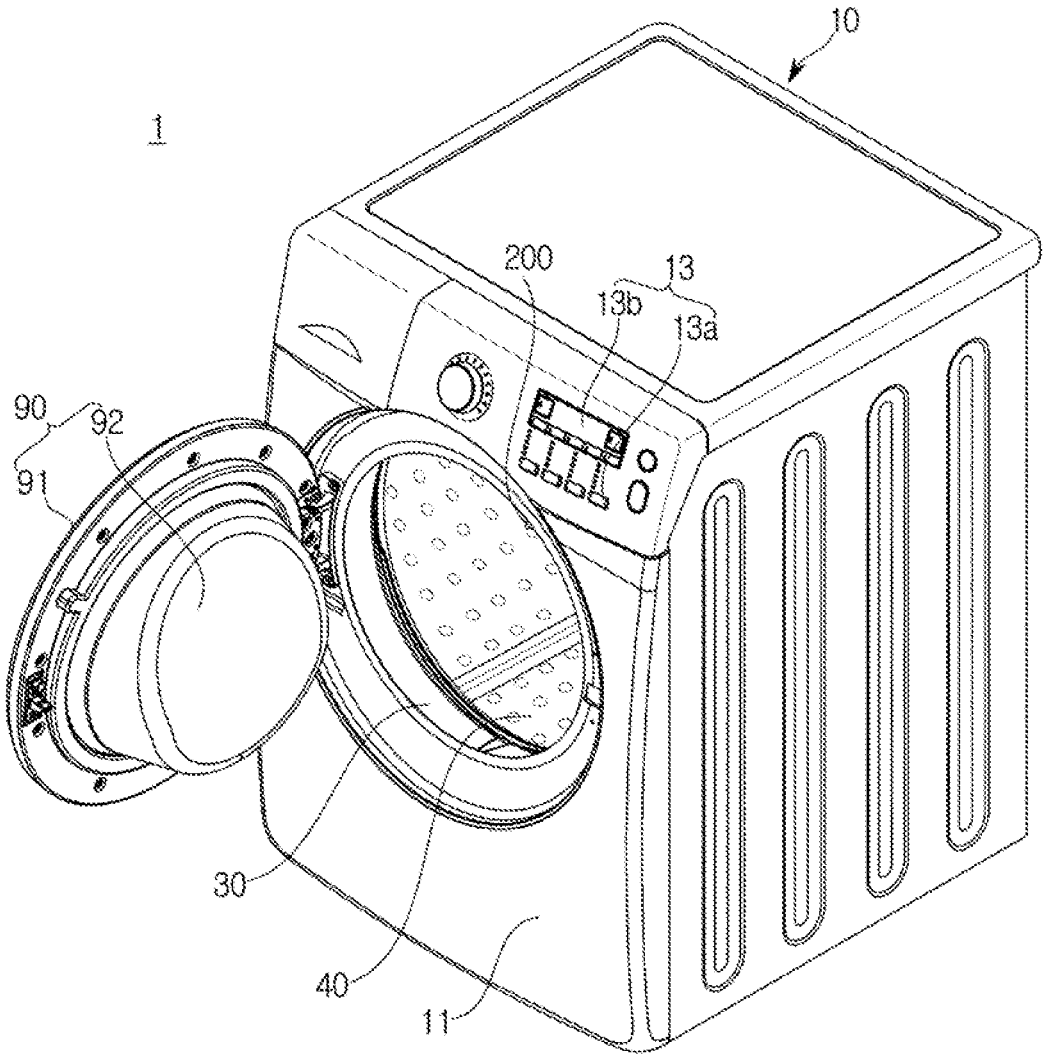
FIG. 2 is a perspective view illustrating an opened state of a door of the washing apparatus of FIG. 1.

FIG. 1 is a side cross-sectional view illustrating a schematic configuration of a washing apparatus according to one embodiment of the present invention. FIG. 2 is a perspective view illustrating an opened state of a door of the washing apparatus of FIG. 1.

Referring to FIGS. 1 to 2, a washing apparatus 1 may include a main body 10 forming an exterior and accommodating various elements therein, a tub 20 provided inside the main body 10 to store washing water, a drum 40 accommodating laundry and rotated, and a driving motor 17 rotating the drum 40.

The main body 10 may have an approximately box shape. The main body 10 may have a front surface plate 11, a rear surface plate, an upper surface plate, a bottom surface plate and a side surface plate.

A control panel 13 having an input part 13*a* for receiving a control command from a user and a display unit 13*b* for displaying operation information of the washing apparatus 1 may be provided at the front surface plate 11. An entrance 12 may be formed at the front surface plate 11 so that the laundry can be put into the drum 40.

The entrance 12 of the main body 10 may be opened and closed by a door 90. The door 90 may be rotatably coupled to the main body 10 by a hinge member. The door 90 may be configured with a door frame 91 and a glass member 92.

The glass member 92 may be formed of a transparent tempered glass material so that an inside of the main body 10 is seen through. The glass member 92 may be provided to protrude toward an inside of the tub 20 such that the laundry is prevented from being biased toward the door 90.

The tub 20 may serve to store the washing water and may be formed in an approximately cylindrical shape. The tub 20 may be fixed to the inside of the main body 10. An opening 21 may be formed at a front surface of the tub 20 to correspond to the entrance 12.

The entrance 12 of the front surface plate 11 of the main body 10 and the opening 21 of the tub 20 may be connected by a diaphragm 30. The diaphragm 30 may form a path between the entrance 12 of the front surface plate 11 of the main body 10 and the opening 21 of the tub 20, may guide the laundry put into the entrance 12 to an inside of the drum 40 and may reduce vibration generated upon rotation of the drum 40 from being transmitted to the main body 10. To this end, the diaphragm 30 may include a buffer 32 bent between the main body 10 and the tub 20. This will be described below.

The drum 40 may have an approximately cylindrical shape of which a front surface is opened and may be provided inside the tub 20. The drum 40 may be rotated inside the tub 20. The drum 40 may perform a washing operation by lifting up and dropping the laundry while being rotated. To this end, a plurality of lifters 41 for lifting up the laundry when the drum 40 is rotated may be provided at an inner circumferential surface of the drum 40. A plurality of through-holes 42 may be formed at a circumference of the drum 40 so that the washing water stored in the tub 20 can flow therethrough.

A first water supply pipe 14 for supplying the washing water into the tub 20 may be provided above the tub 20. The first water supply pipe 14 may receive the washing water from an external water supply source. Also, the first water supply pipe 14 may be opened and closed by a first water supply valve 14*a*.

A detergent supply device 15 for supplying a detergent into the tub 20 may be provided at a front upper portion of the main body 10. The detergent supply device 15 may be connected to the tub 20 through a supply pipe 16. The washing water supplied through the first water supply pipe 14 may pass through the detergent supply device 15 and thus may be supplied into the tub 20 together with the detergent.

The driving motor 17 generating a rotating force for rotating the drum 40 may be provided at a rear surface of the tub 20. The driving motor 17 may include a fixed stator 17*a* and a rotor 17*b* electromagnetically interacting with the stator 17*a* to be rotated and may convert an electric force into a mechanical rotating force.

The rotating force generated from the driving motor 17 may be transmitted to the drum 40 through a driving shaft 18. The driving shaft 18 may be provided to be fitted into the rotor 17*b* of the driving motor 17, thereby being rotated along with the rotor 17*b*, may pass through a rear wall of the tub 20 and thus may connect the drum 40 with the driving motor 17.

The washing apparatus 1 may include a drainage device 50 for discharging the washing water drained from the tub 20 to an outside. The drainage device 50 may include a pump chamber 52 provided under the tub 20 to store the washing water drained from the tub 20, a connection hose 51 for connecting the pump chamber 52 with a drainage hole 22 of the tub 20, and a drainage hose 56 for guiding the washing water stored in the pump chamber 52 to be discharged to the outside.

The connection hose 51 may guide the washing water supplied into the tub 20 and used for the washing operation into the pump chamber 52. As a result, the washing water used for the washing operation may be stored in the pump chamber 52.

The pump chamber 52 may discharge the stored washing water. To this end, a drainage pump for discharging the stored washing water to an outside of the main body 10 may be provided inside the pump chamber 52, and the washing water pumped by the drainage pump may be guided to the outside of the main body 10 through the drainage hose 56.

Also, a second water supply pipe 19 for supplying the washing water into the washing apparatus 1 may be provided above the tub 20. The second water supply pipe 19 may receive the washing water from an external water supply source. The second water supply pipe 19 may be opened and closed by a second water supply valve 19*a*.

The washing water supplied through the first water supply pipe 14 is supplied into the tub 20 via the detergent supply device 15, but the washing water supplied through the second water supply pipe 19 may be supplied into the washing apparatus 1 without passing through the detergent supply device 15. As a result, the washing water supplied through the second water supply pipe 19 may not include the detergent.

One end of the second water supply pipe 19 may be connected to an outside to receive the washing water, and the other end thereof may be branched and connected to a door washing nozzle 100 and a washing reinforcement nozzle 200.

The door washing nozzle 100 may be installed on the diaphragm 30 to inject the washing water to the door 90. Specifically, the door washing nozzle 100 may be installed at a center above the diaphragm 30 and may inject the washing water directly thereunder. As described above, since the glass member 92 of the door 90 is provided to protrude toward the inside of the tub 20, the washing water injected directly thereunder may wash the door 90 by arriving at the glass member 92 of the door 90.

When the glass member 92 is stained with bubbles generated inside the door 90 during a washing stroke of the washing apparatus 1, it may give a user an unpleasant feeling after the washing operation for the laundry is completed, regardless of a washing degree of the laundry. Therefore, in the washing apparatus 1, if necessary, the washing water may be injected to the glass member 92 of the door 90 using the door washing nozzle 100 while the laundry is washed, and thus the bubbles on the glass member 92 may be removed.

The washing reinforcement nozzle 200 may be installed on the diaphragm 30 to inject the washing water into the drum 40. Specifically, the washing reinforcement nozzle 200 may be provided to be inclined toward an inside of the drum 40 to have an injection angle which does not interfere with the protruding door 90. FIGS. 1 and 2 illustrate an example in which the washing reinforcement nozzle 200 is installed at a right side of an upper portion of the diaphragm 30. However, the washing reinforcement nozzle 200 may be installed at various positions on the diaphragm 30 within the technical spirit in which the washing water does not interfere with the door 90.

Meanwhile, as described above, the diaphragm 30 may include the buffer 32 for performing a buffering action. Since the buffer 32 is a bent area of the diaphragm 30, a foreign substance such as a lint contaminant and the detergent may be more easily accumulated thereon than other areas. When the foreign substance accumulated on the buffer 32 of the diaphragm 30 is increased, it may influence washing performance of the washing apparatus 1, may also create an environment in which microbes are attached thereon and thus may give an unpleasant feeling to the user.

Accordingly, the washing apparatus 1 in which a means and/or a method for washing the diaphragm 30 are/is employed is required. Hereinafter, one embodiment of the washing apparatus 1 in which the method for washing the diaphragm 30 is employed will be first described, and then one embodiment of the washing apparatus 1 in which the means for washing the diaphragm 30 is employed will be described.

Figure 3:
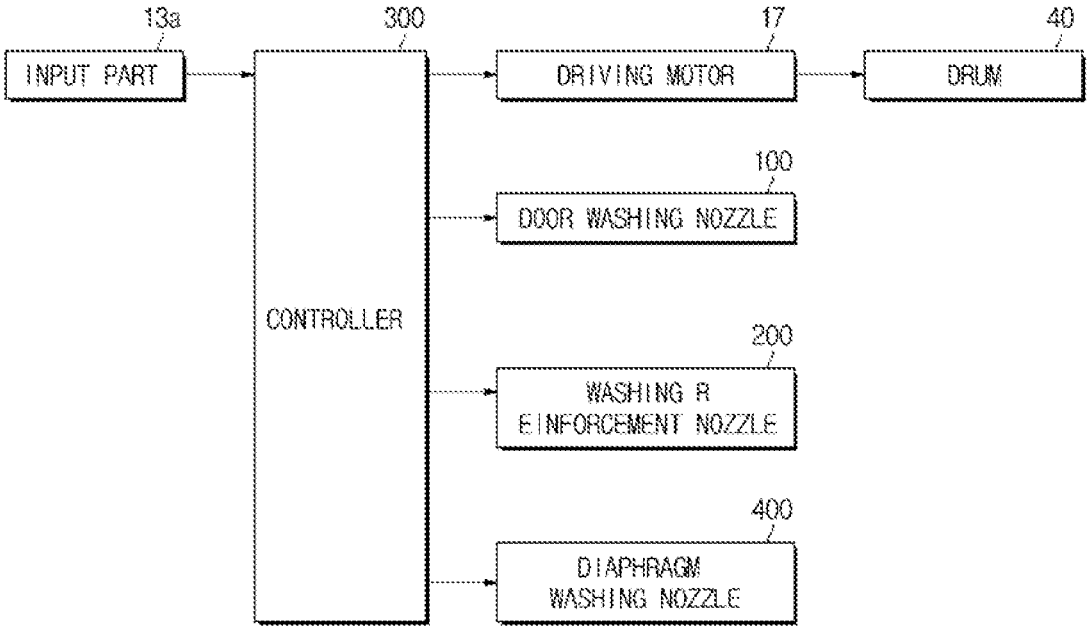
FIG. 3 is a control block diagram of the washing apparatus according to one embodiment.

FIG. 3 is a control block diagram of the washing apparatus according to one embodiment.

Referring to FIG. 3, a washing apparatus 1 according to one embodiment may include an input part 13*a*, a controller 300, a driving motor 17, a drum 40, a door washing nozzle 100 and a washing reinforcement nozzle 200. Here, since the input part 13*a*, the driving motor 17, the drum 40, the door washing nozzle 100 and the washing reinforcement nozzle 200 are the same as those described in FIGS. 1 and 2, detailed descriptions thereof will be omitted. Hereinafter, it will be described centering on a method in which the controller 300 controls each of elements.

When the washing apparatus 1 enters a washing mode of the diaphragm 30, the controller 300 may control each of elements of the washing apparatus 1 according to a predetermined algorithm for washing the diaphragm 30.

Figure 4:
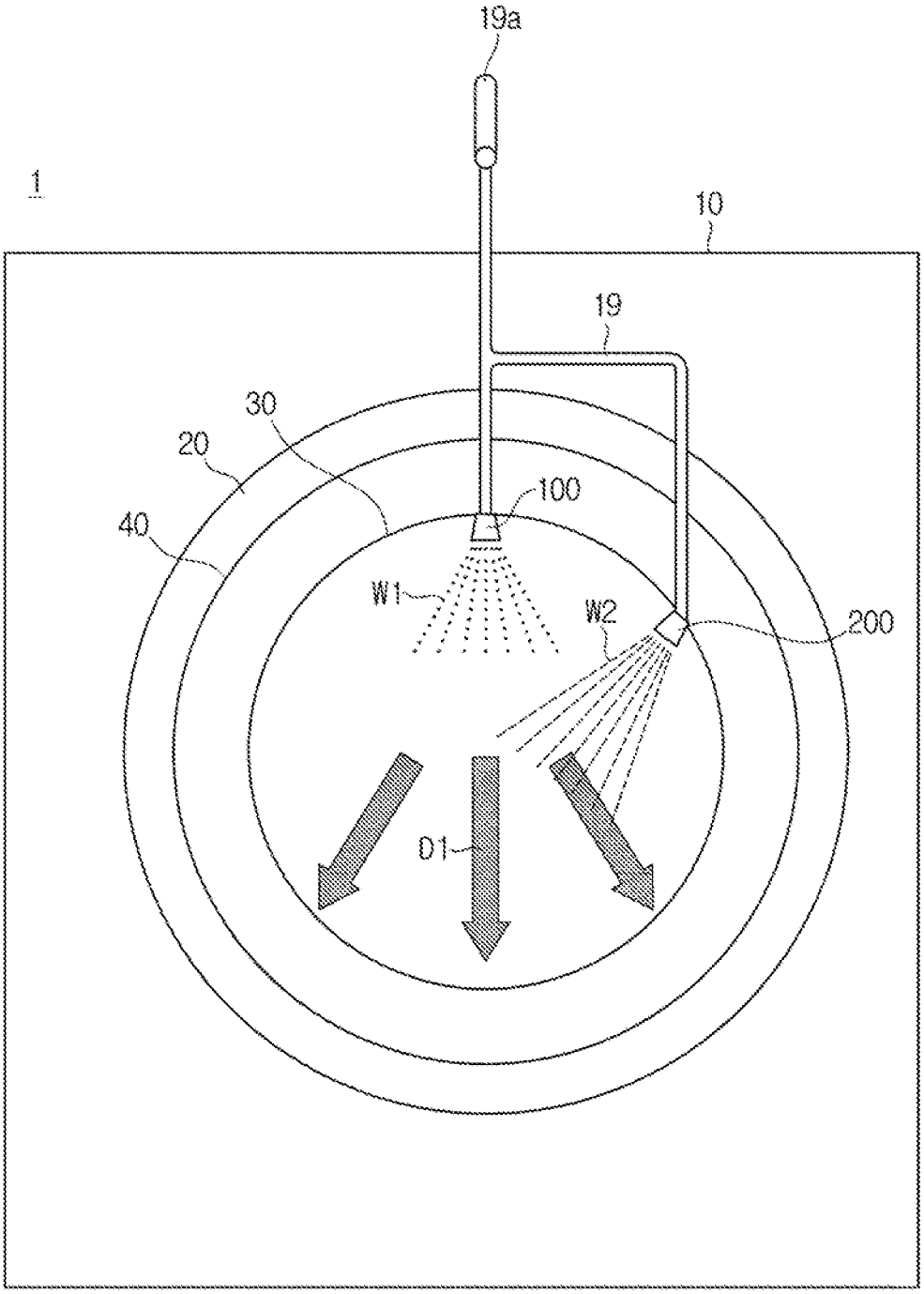
FIGS. 4 and 5 are schematic views of the washing apparatus when being seen from a front side to explain a method for washing the diaphragm in the washing apparatus according to one embodiment.
Figure 5:
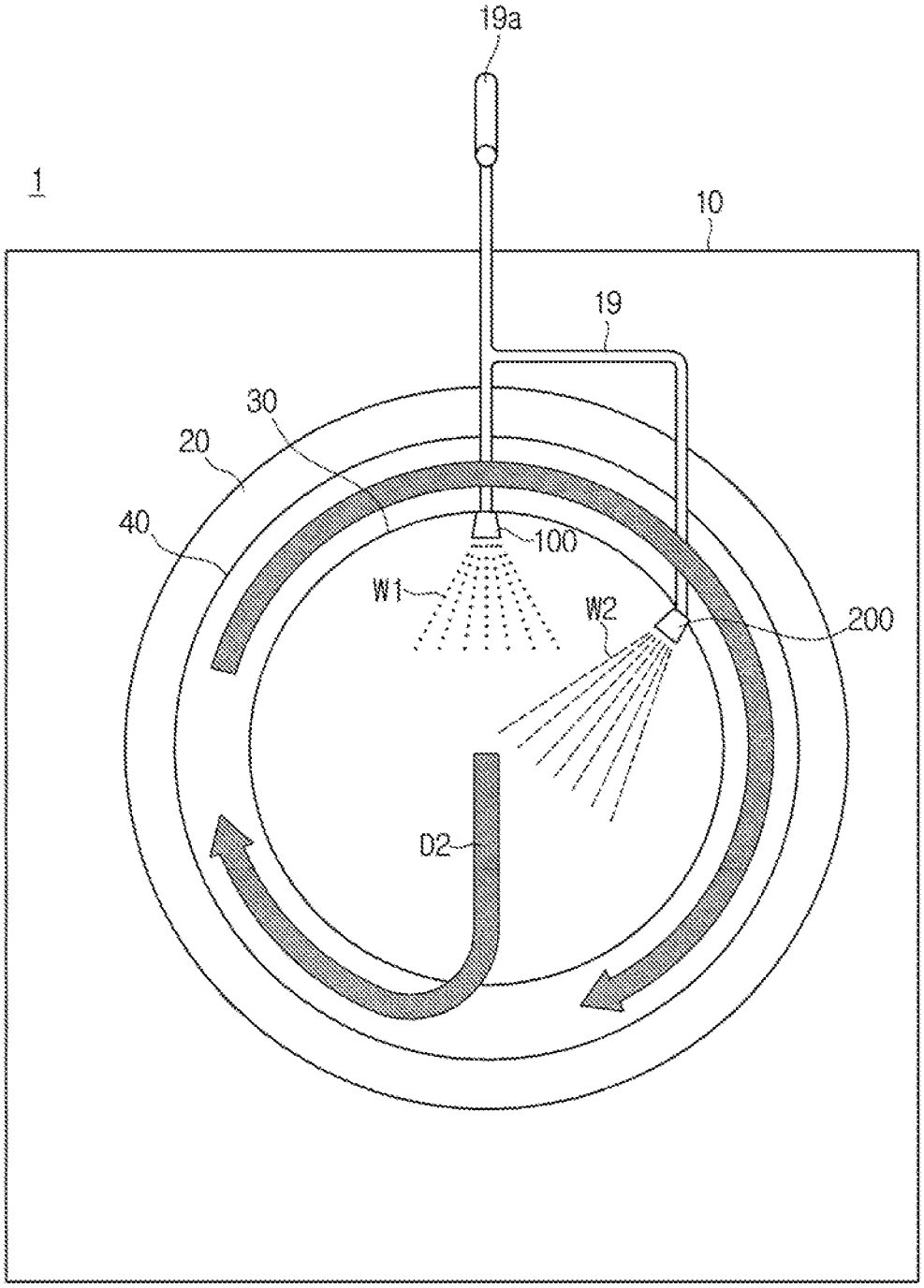
Figure 6:
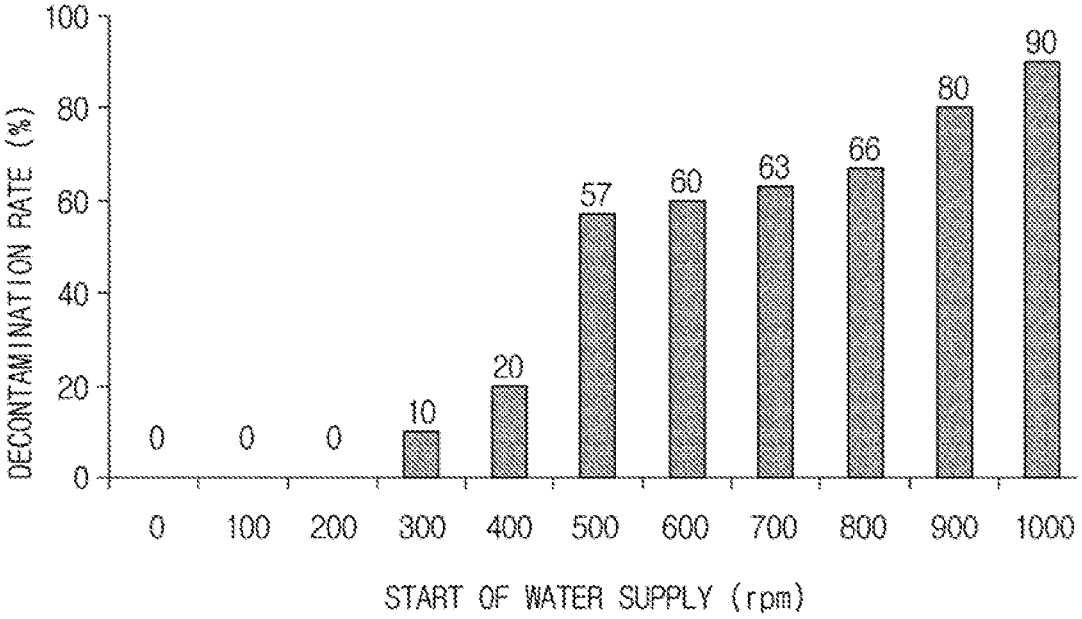
FIG. 6 is a graph illustrating a decontamination rate of the diaphragm according to a rotation speed of the drum in the washing apparatus in which the method for washing the diaphragm according to one embodiment is employed.

FIGS. 4 and 5 are schematic views of the washing apparatus when being seen from a front side to explain a method for washing the diaphragm in the washing apparatus according to one embodiment, and FIG. 6 is a graph illustrating a decontamination rate of the diaphragm according to a rotation speed of the drum in the washing apparatus in which the method for washing the diaphragm according to one embodiment is employed.

FIGS. 4 and 5 illustrate an example in which the tub 20, the drum 40 and the diaphragm 30 form concentric circles when the washing apparatus 1 is seen from a front side and have diameters which become larger in the order of the tub 20, the drum 40 and the diaphragm 30. Also, FIG. 4 illustrates an example in which the drum 40 is stopped or rotated at a low speed, and FIG. 5 illustrates an example in which the drum 40 is rotated at a high speed. Also, for convenience of explanation, FIGS. 4 and 5 are subject to a condition in which the drum 40 is rotated clockwise.

Referring to FIG. 4, the controller 300 may inject the washing water through the door washing nozzle 100 and the washing reinforcement nozzle 200. To this end, the controller 300 may directly control the door washing nozzle 100 and the washing reinforcement nozzle 200, or otherwise may control the second water supply valve 19*a* of the second water supply pipe 19.

The door washing nozzle 100 may be provided to inject the washing water W1 toward the door 90, and the washing reinforcement nozzle 200 may be provided to inject the washing water W2 toward the inside of the drum 40. However, some of the injected washing water may be introduced to the buffer 32 which is the bent area of the diaphragm 30. The washing water W1 and W2 introduced to the buffer 32 may be used to wash the diaphragm 30.

However, as illustrated in FIG. 4, when the drum 40 is stopped or rotated at the low speed, the washing water W1 supplied through the door washing nozzle 100 and the washing water W2 supplied through the washing reinforcement nozzle 200 flows in a direction D1 by a force of gravity. That is, since an external force except the force of gravity is not applied to the washing water W1 and W2 injected through each of the door washing nozzle 100 and the washing reinforcement nozzle 200, the washing water W1 and W2 may be moved toward a lower portion of the diaphragm 30. As a result, the washing water W1 and W2 may not be introduced to the buffer 32 of the diaphragm 30, or only a very small amount thereof may be introduced thereto.

Therefore, the controller 300 may control the driving motor 17 to rotate the drum 40 at the high speed, such that the washing water can provide an external force to the buffer 32 of the diaphragm 30. Referring to FIG. 5, when the drum 40 is rotated at the high speed, air in the drum 40 may flow while being rotated clockwise from a center of the drum 40 toward a circumference thereof. When a force due to a flow of the air is applied to the washing water W1 and W2, the washing water W1 and W2 may also be rotated clockwise and may be introduced to the buffer 32 of the diaphragm 30. As a result, as illustrated in FIG. 5, the washing water W1 and W2 introduced to the buffer 32 of the diaphragm 30 may be rotated in a direction D2 and may remove the foreign substance on the buffer 32 of the diaphragm 30.

At this point, the rotation speed of the drum 40 at the washing mode of the diaphragm 30 may be variously selected within the technical spirit in which the washing water injected through the door washing nozzle 100 and the washing reinforcement nozzle 200 can be introduced to the buffer 32 and can be rotated.

For example, when the washing apparatus enters the washing mode of diaphragm 30 at the same time that a rinsing stroke and/or a spin-drying stroke start(s), the controller 300 may accelerate the drum 40 in a stopped state until the drum 40 arrives at a final target rotation speed. When the drum 40 arrives at a predetermined reference rotation speed, the controller 300 may control the door washing nozzle 100 and the washing reinforcement nozzle 200 to inject the washing water for a predetermined time.

FIG. 6 is a graph illustrating a decontamination rate when 5 L of washing water is supplied through the door washing nozzle 100 and the washing reinforcement nozzle 200 at different water supply time points from each other while the drum 40 in the stopped state is accelerated. Here, it is assumed that the contaminants are artificially manufactured substances including lint, dust and the detergent.

Referring to FIG. 6, when the drum 40 is stopped or rotated at a low speed of 200 RPM or less, it may be confirmed that the contaminants on the diaphragm 30 are not removed even when the washing water is supplied through the door washing nozzle 100 and the washing reinforcement nozzle 200. That is, when the drum 40 is rotated at the low speed of 200 RPM or less, the washing water may flow in the direction D1, as illustrated in FIG. 4, and thus may not enter the buffer 32 of the diaphragm 30, or may not have sufficient movement which can remove the contaminants although entering the buffer 32.

However, when the drum 40 is rotated at a rotation speed of 300 RPM or more, the washing water supplied through the door washing nozzle 100 and the washing reinforcement nozzle 200 may be used to remove the contaminants of the diaphragm 30. That is, when the drum 40 is rotated at the rotation speed of 300 RPM or more, the washing water may flow in the direction D2, as illustrated in FIG. 5 and then may remove the contaminants by being rotated after entering the buffer 32 of the diaphragm 30.

Therefore, while the drum 40 in the stopped state is acceleratedly rotated to arrive at the target rotation speed, the controller 300 may control the door washing nozzle 100 and the washing reinforcement nozzle 200 to inject the washing water when the drum 40 is rotated at 300 RPM or more.

Also, in FIG. 6, the decontamination rate becomes higher, as the water supply starts at a time point that the rotation speed of the drum 40 is faster. However, when the washing apparatus 1 enters the washing mode of the diaphragm 30 at the same time that the spin-drying stroke starts, the washing water injected through the door washing nozzle 100 and the washing reinforcement nozzle 200 may reduce spin-drying efficiency. Therefore, the controller 300 may classify sections of the washing mode of the diaphragm 30 according to the rotation speed of the drum 40 which is acceleratedly rotated and may control the door washing nozzle 100 and the washing reinforcement nozzle 200 to inject the washing water for an optimal time at an optimal time point which can minimize an influence on the spin-drying efficiency in each of the sections.

Specifically, the controller 300 may classify the washing mode of the diaphragm 30 into a first section in which the drum 40 in the stopped state is accelerated with a first rotational acceleration to arrive at a first target rotation speed and a second section in which the drum 40 rotated at the first target rotation speed is accelerated with a second rotational acceleration to arrive at a second target rotation speed.

The rotation of the drum 40 may correspond to the rotation of the drum 40 at the spin-drying stroke and/or the rinsing stroke. For example, the drum 40 at the spin-drying stroke may arrive at a primarily predetermined rotation speed, then may be constantly rotated for a predetermined time at a corresponding speed and may be acceleratedly rotated until arriving at a final target rotation speed. This is to control a balance of the drum 40 according to the rotation and also to reduce a load. At this point, a time from a stopped time point to a time point just before the constant rotation may correspond to the first section of the washing mode of the diaphragm 30, and a time from a time point after the constant rotation to a time point when arriving at the final target rotation speed may correspond to the second section.

In the case in which the washing mode of the diaphragm 30 is classified into the sections, the controller 300 may control the door washing nozzle 100 and the washing reinforcement nozzle 200 to inject the washing water for a first time in the first section when the washing apparatus 1 enters the first section of the washing mode of the diaphragm 30. Also, the controller 300 may control the door washing nozzle 100 and the washing reinforcement nozzle 200 to inject the washing water for a second time in the second section when the washing apparatus 1 enters the second section of the washing mode of the diaphragm 30.

For example, in the case in which the washing mode of the diaphragm 30 is classified into a first section in which the drum 40 at the washing mode of the diaphragm 30 has a rotation speed of 0 to 500 RPM and a second section in which the drum 40 at the washing mode of the diaphragm 30 has a rotation speed of 500 to 1150 RPM, the controller 300 may control the door washing nozzle 100 and the washing reinforcement nozzle 200 to inject the washing water for 5 seconds when the rotation speed of the drum 40 in the first section arrives at 300 RPM and also to inject the washing water for 5 seconds when the rotation speed of the drum 40 in the second section arrives at 1050 RPM.

Accordingly, it is possible to increase the washing efficiency of the diaphragm 30 and also to prevent a degradation of the spin-drying efficiency when the washing of the diaphragm 30 is performed simultaneously with the spin-drying stroke.

Until now, the method of washing the diaphragm 30 using the door washing nozzle 100 and the washing reinforcement nozzle 200 has been described.

Hereinafter, the washing apparatus including a separate means for washing the diaphragm 30 will be described.

Referring to FIG. 3 again, the washing apparatus 1 according to one embodiment may further include a diaphragm washing nozzle 400. The diaphragm washing nozzle 400 may be provided on the buffer 32 of the diaphragm 30 and may directly inject the washing water to the buffer 32.

Figure 7:
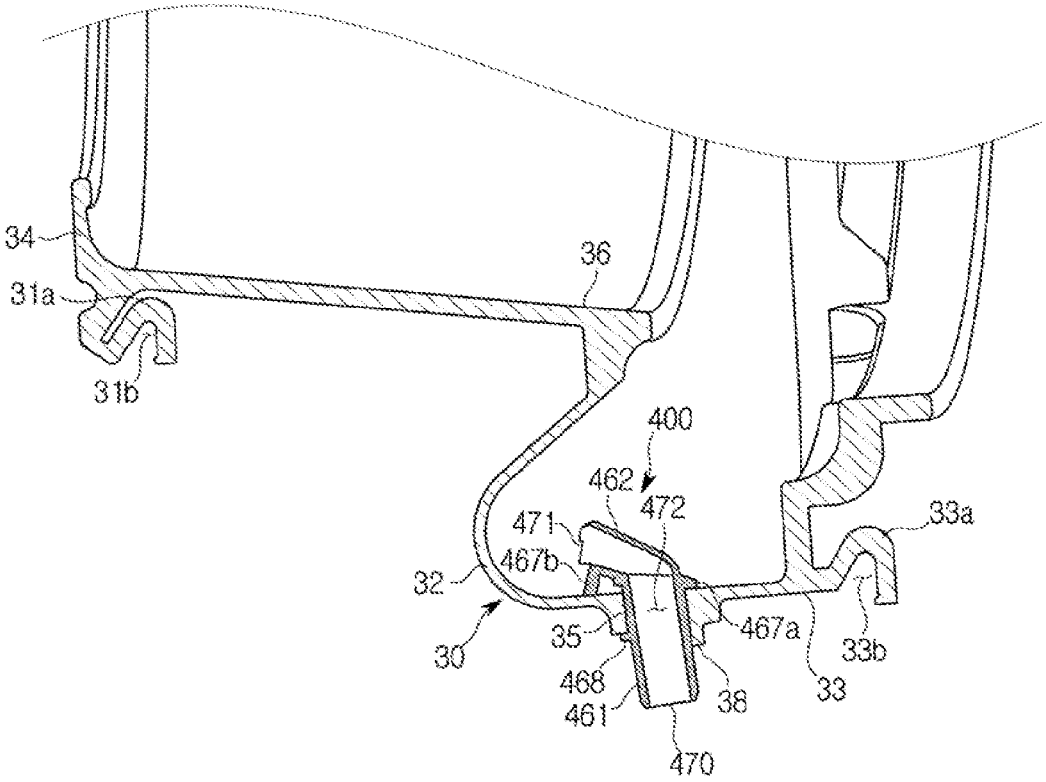
FIG. 7 is a cross-sectional view illustrating a detailed configuration of the diaphragm and the diaphragm washing nozzle of the washing apparatus according to one embodiment.

FIG. 7 is a cross-sectional view illustrating a detailed configuration of the diaphragm and the diaphragm washing nozzle of the washing apparatus according to one embodiment.

The diaphragm 30 may be formed of an elastic rubber material and may have an approximately ring shape. The diaphragm 30 may include a front portion 31 provided at a relative front side and coupled to the entrance 12 of the main body 10, a rear portion 33 provided at a relative rear side and coupled to the opening 21 of the tub 20, and a buffer 32 connecting the front portion 31 with the rear portion 33 and bent at least once or more to perform a buffering action.

A front coupling part 31*a* hooked and coupled to the entrance 12 of the main body 10 may be formed at an end of the front portion 31, and a coupling ring installation groove 31*b* at which a coupling ring (not shown) for surrounding and fixing the main body 10 and the front coupling part 31*a* may be formed at an outer side of the front coupling part 31*a*. Also, a door sealing part 34 which is in close contact with the glass member 92 of the door 90 to be sealed may be provided at the front portion 31.

A rear coupling part 33*a* hooked and coupled to the opening 21 of the tub 20 may be formed at an end of the rear portion 33, and a coupling ring installation groove 33*b* at which a coupling ring (not shown) for surrounding and fixing the tub 20 and the rear coupling part 33*a* may be formed at an outer side of the rear coupling part 33*a*.

The above described door washing nozzle 100 and washing reinforcement nozzle 200 serve to inject the washing water into the door and the drum, respectively, and are generally provided on the front portion 31 of the diaphragm 30.

However, the diaphragm washing nozzle 400 may pass through one surface of the buffer 32 to directly inject the washing water to the buffer 32. To this end, a coupling hole 35 may be formed at the buffer 32 so that the diaphragm washing nozzle 400 can pass therethrough and then can be coupled therein. A boss 38 may be formed around the coupling hole 35 to support the diaphragm washing nozzle 400 passing through the coupling hole 35.

The diaphragm washing nozzle 400 may include a coupling part 461 installed to pass through the diaphragm 30 and an injector 462 extending from the coupling part 461 to guide a direction of the washing water.

The coupling part 461 may have an approximately cylindrical shape and may be coupled to the second water supply pipe 19. The injector 462 may have a fan shape so that the injected washing water can be widely spread.

The diaphragm washing nozzle 400 may include an inlet port 470 through which the washing water is introduced from the second water supply pipe 19, an injection port 471 through which the washing water is injected, and a flowing space 472 connecting the inlet port 470 with the injection port 471.

The inlet port 470 may be formed in an approximately circular shape, and the injection port 471 may be formed in an approximately rectangular shape so that the washing water can be widely spread.

The diaphragm washing nozzle 400 may have inner fixing parts 467*a* and 467*b* which are in close contact with and supported by a radial inner side of the diaphragm 30. The diaphragm washing nozzle 400 may have an outer fixing part 468 which is in close contact with and supported by a radial outer side of the diaphragm 30. The outer fixing part 468 may protrude from an outer circumferential surface of the coupling part 461.

At this point, the diaphragm washing nozzle 400 may be provided on the buffer 32 of the diaphragm 30 corresponding to a rotational direction of the drum 40. Hereinafter, a position at which the diaphragm washing nozzle 400 is provided will be described in detail with reference to FIGS. 8 and 9.

Figure 8:
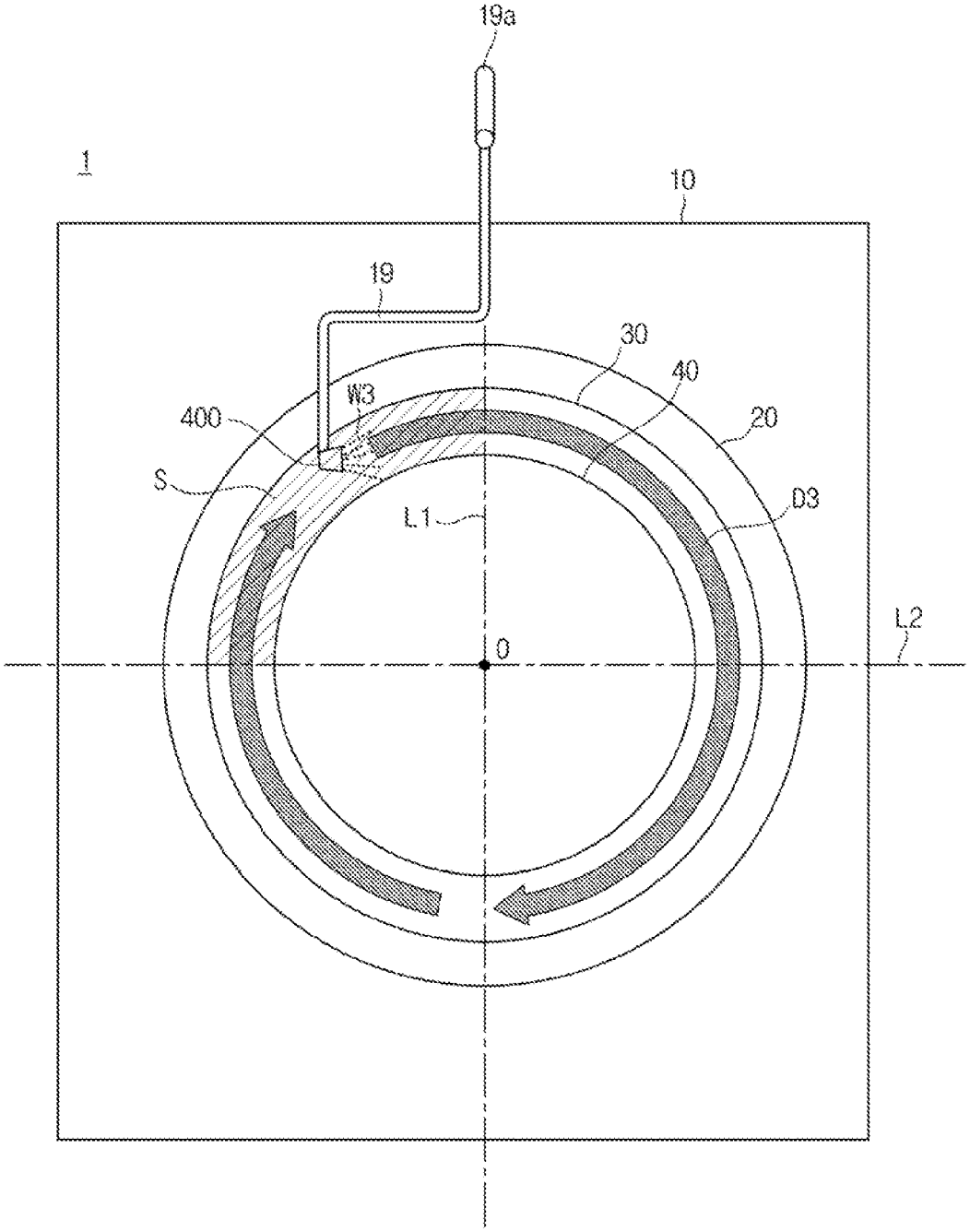
FIGS. 8 and 9 are views illustrating the position of the diaphragm washing nozzle according to one embodiment.
Figure 9:
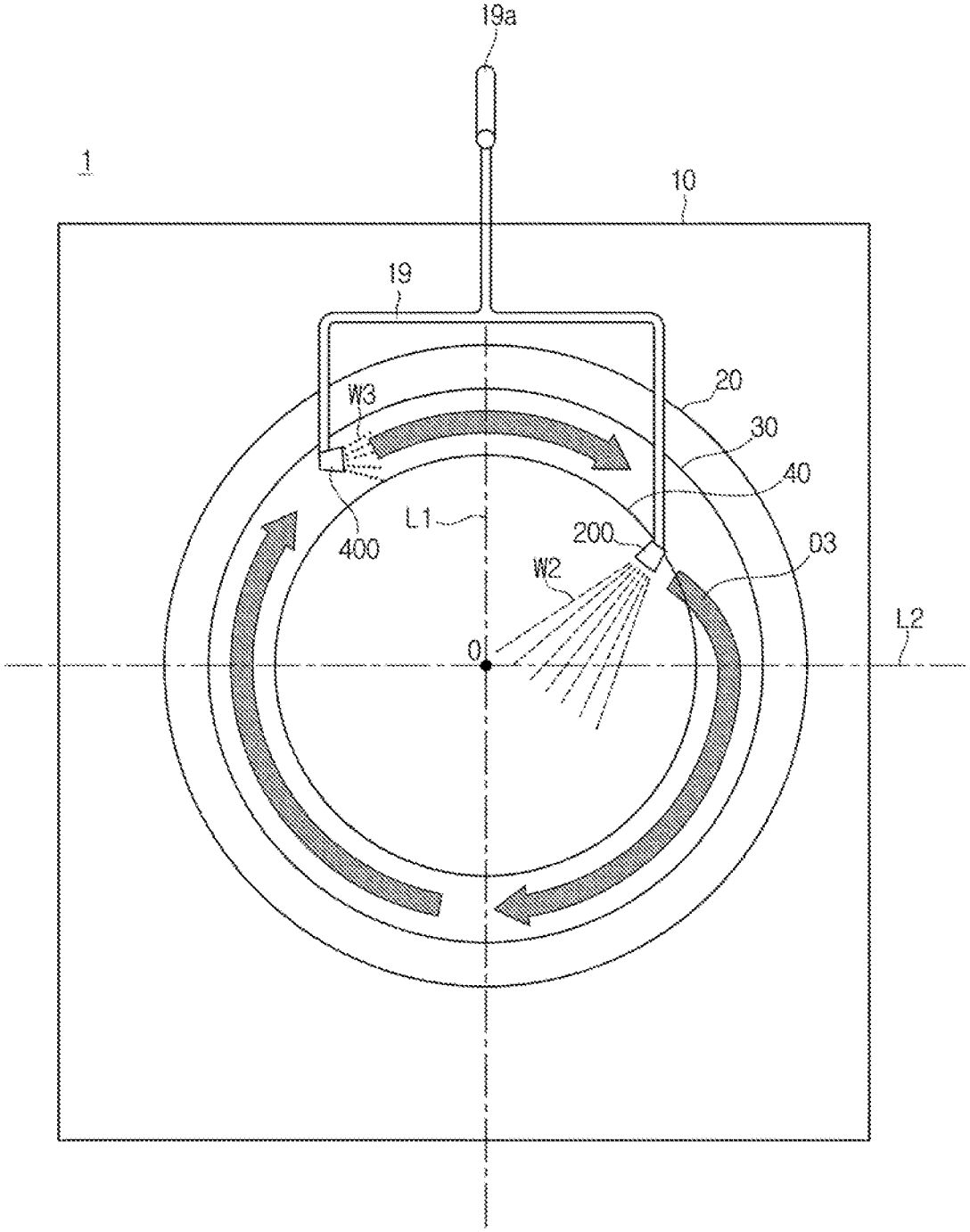

FIGS. 8 and 9 are views illustrating the position of the diaphragm washing nozzle according to one embodiment. FIGS. 8 and 9 illustrate an example in which the tub 20, the drum 40 and the diaphragm 30 form concentric circles based on a center O when the washing apparatus 1 is seen from the front side and have diameters which become larger in the order of the tub 20, the drum 40 and the diaphragm 30. Also, FIG. 8 illustrates an example in which the diaphragm washing nozzle 400 is provided on the diaphragm 30, and FIG. 9 illustrates an example in which the diaphragm washing nozzle 400 and the washing reinforcement nozzle 200 are provided on the diaphragm 30. Also, in FIGS. 8 and 9, for convenience of explanation, it is assumed that the drum 40 is rotated clockwise.

As described above, when the drum 40 is rotated, the washing water may be rotated in the same direction as the rotational direction of the drum 40 and may wash the buffer 32 of the diaphragm 30. Therefore, the diaphragm washing nozzle 400 may increase the washing efficiency by injecting the washing water in the rotational direction of the drum 40.

At this point, the diaphragm washing nozzle 400 may be installed at a position on the diaphragm 30 corresponding to a position of the rotational direction of the drum 40. Specifically, when the drum 40 is rotated clockwise, the diaphragm washing nozzle 400 may be installed at an upper left side of the diaphragm 30, and when the drum 40 is rotated counterclockwise, the diaphragm washing nozzle 400 may be installed at an upper right side of the diaphragm 30.

Referring to FIG. 8, the position on the diaphragm 30 may be distinguished by a first reference line L1 vertical to a lower surface passing through the center O of the concentric circles and a second reference line L2 passing through the center O of the concentric circles and vertical to the first reference line L1. Specifically, an area of the diaphragm 30 located at an upper side based on the second reference line L2 and a left side based on the first reference line L1 may be defined as an upper left area of the diaphragm 30, and an area thereof located at the upper side based on the second reference line L2 and a right side based on the first reference line L1 may be defined as an upper right area of the diaphragm 30.

When the drum 40 is rotated clockwise and the diaphragm washing nozzle 400 injecting the washing water clockwise is located at an upper center (on the first reference line L1), the upper left area (a hatched area in FIGS. 8 and 9) of the diaphragm 30 may not be effectively washed. Since the washing water injected from the upper center is moved in an opposite direction to the force of gravity while passing through a lower center, it may be difficult for the washing water to reach the upper left area.

On the other hand, as illustrated in FIG. 8, when the diaphragm washing nozzle 400 is installed at the upper left area of the diaphragm 30, the washing water may first pass through the upper left area and thus may perform the washing operation of a corresponding area.

FIG. 8 has illustrated an example in which only the diaphragm washing nozzle 400 is provided on the diaphragm 30. However, as illustrated in FIG. 9, the diaphragm washing nozzle 400 and the washing reinforcement nozzle 200 may be provided together on the diaphragm 30. Also, the door washing nozzle 100 may also be provided together on the diaphragm 30. By such a configuration, a washing force for the diaphragm 30 may be increased.

Even when the diaphragm washing nozzle 400 is installed, the controller 300 may control the drum 40 and the diaphragm washing nozzle 400 in the same method described through FIG. 5. Specifically, when the washing apparatus 1 enters the washing mode of the diaphragm 30, the controller 300 may control the diaphragm washing nozzle 400 to inject the washing water for the first time in the first section and then to inject the washing water for the second time in the second section.

Since the diaphragm washing nozzle 400 is additionally provided at the position corresponding to the rotational direction of the drum 40, the washing efficiency of the diaphragm 30 according to the washing mode of the diaphragm 30 may be maximized.

Until now, an example in which the washing apparatus 1 enters the washing mode of the diaphragm 30 when the rinsing stroke or the spin-drying stroke starts has been described. However, the user may input a command for entering the washing mode of the diaphragm 30, and thus the washing apparatus 1 may enter the washing mode of the diaphragm 30.

The user may want to perform the washing operation of the diaphragm 30 regardless of the washing operation of the laundry. In this case, the input part 13*a* may receive an input of the command for entering the washing mode of the diaphragm 30 from the user. When the command for entering the washing mode of the diaphragm 30 is input, the controller 300 may control each of the elements of the washing apparatus 1 to perform the washing operation of the diaphragm 30.

Figure 10A:
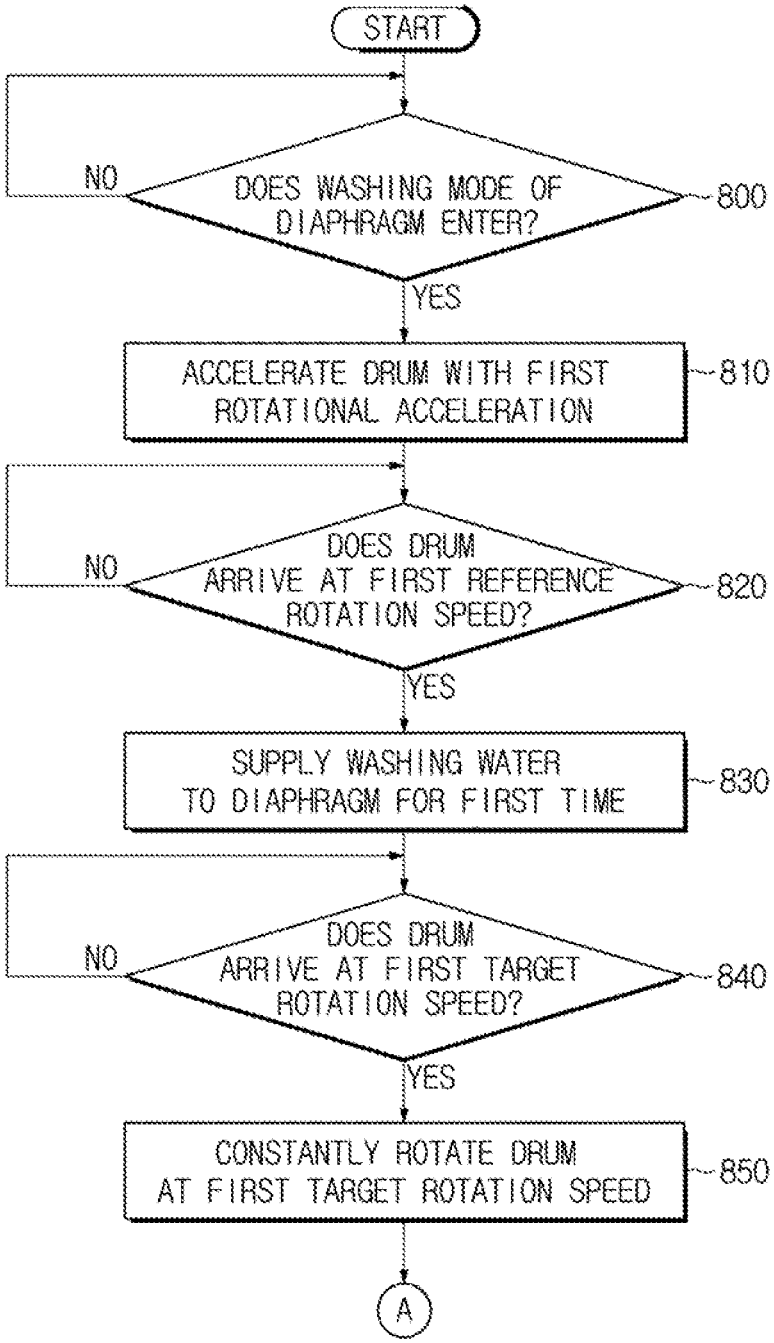
FIGS. 10A and 10B are flowcharts of a method of controlling the washing apparatus according to one embodiment.
Figure 10B:
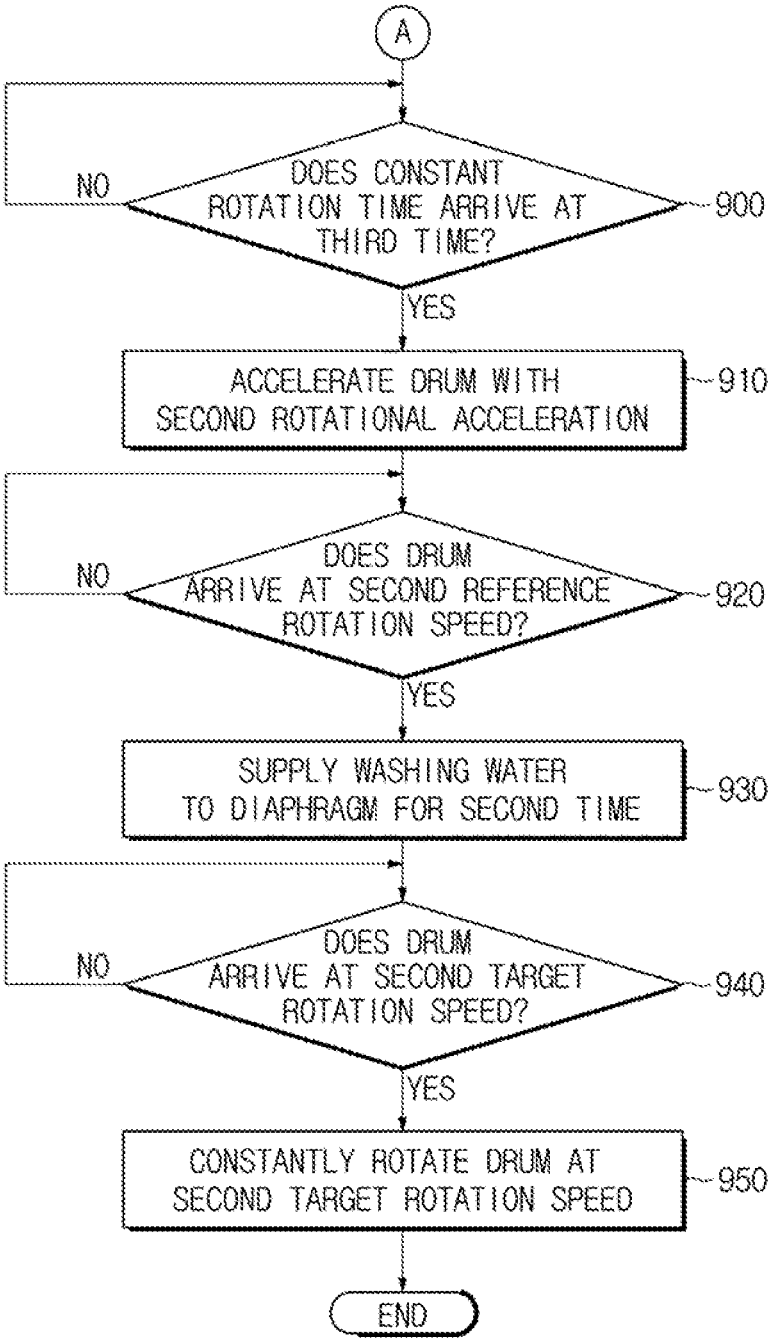

FIGS. 10A and 10B are flowcharts of a method of controlling the washing apparatus according to one embodiment.

First, the washing apparatus 1 may check whether the washing mode of the diaphragm 30 is entered (800). Here, the washing mode of the diaphragm 30 may be entered at the same time when the rinsing stroke and the spin-drying stroke start, or may be entered when the command for entering the washing mode of the diaphragm 30 is input. When the washing mode of the diaphragm 30 is not entered, the washing apparatus 1 may repeatedly check this.

On the other hand, when the washing mode of the diaphragm 30 is entered, the washing apparatus 1 may accelerate the drum 40 with the first rotational acceleration (810). Specifically, the washing apparatus 1 may accelerated rotate the drum 40 with the first rotational acceleration under an assumption that the first section in the washing mode of the diaphragm 30 is entered, such that the drum 40 arrives at the first target rotation speed.

The washing apparatus 1 may check whether the drum 40 arrives at a first reference rotation speed while accelerating the drum 40 (820). Here, the first reference rotation speed may be a rotation speed of the drum 40 having the optimal washing efficiency of the diaphragm 30 in the first section. When the drum 40 does not yet arrive at the first reference rotation speed, the washing apparatus 1 may repeatedly check this.

On the other hand, when the drum 40 arrives at the first reference rotation speed, the washing apparatus 1 may supply the washing water to the diaphragm 30 for the first time (830). For example, assuming that the first reference rotation speed is 300 RPM and the first time is 5 seconds, the washing apparatus 1 may supply the washing water to the diaphragm 30 for 5 seconds from a moment when the drum 40 accelerated with the first rotational acceleration arrives at 300 RPM.

To supply the washing water to the diaphragm 30, the washing apparatus 1 may use at least one of the door washing nozzle 100 for injecting the washing water toward the door, the washing reinforcement nozzle 200 for injecting the washing water toward the drum 40 and the diaphragm washing nozzle 400 for providing the washing water to the buffer 32 of the diaphragm 30.

Then, the washing apparatus 1 may check whether the drum 40 arrives at the first target rotation speed (840). When the drum 40 does not yet arrive at the first target rotation speed, the washing apparatus 1 may repeatedly check this.

On the other hand, when the drum 40 arrives at the first target rotation speed, the washing apparatus 1 may constantly rotate the drum 40 at the first target rotation speed (850). Since the fact that the drum 40 arrives at the first target rotation speed means that the first section of the washing mode of the diaphragm 30 is terminated, the washing apparatus 1 may constantly rotate the drum 40 until the second section is entered.

The washing apparatus 1 may check whether a constant rotation time arrives at a third time while constantly rotating the drum 40 (900). The third time is a minimum time for entering the second section after the first section is terminated. If the constant rotation time is a time before arriving at the third time, the washing apparatus 1 may repeatedly check this.

On the other hand, when the constant rotation time arrives at the third time, the washing apparatus 1 may accelerate the drum 40 with the second rotational acceleration (910). Specifically, the washing apparatus 1 may acceleratedly rotate the drum 40 with the second rotational acceleration under an assumption that the second section in the washing mode of the diaphragm 30 is entered, such that the drum 40 arrives at the second target rotation speed.

The washing apparatus 1 may check whether the drum 40 arrives at a second reference rotation speed while accelerating the drum 40 (920). Here, the second reference rotation speed may be a rotation speed of the drum 40 having the optimal washing efficiency of the diaphragm 30 in the second section. When the drum 40 does not yet arrive at the second reference rotation speed, the washing apparatus 1 may repeatedly check this.

On the other hand, when the drum 40 arrives at the second reference rotation speed, the washing apparatus 1 may supply the washing water to the diaphragm 30 for the second time (930). For example, assuming that the second reference rotation speed is 1050 RPM and the second time is 5 seconds, the washing apparatus 1 may supply the washing water to the diaphragm 30 for 5 seconds from a moment when the drum 40 accelerated with the second rotational acceleration arrives at 1050 RPM.

To supply the washing water to the diaphragm 30, the washing apparatus 1 may use at least one of the door washing nozzle 100 for injecting the washing water toward the door, the washing reinforcement nozzle 200 for injecting the washing water toward the drum 40 and the diaphragm washing nozzle 400 for providing the washing water to the buffer 32 of the diaphragm 30.

Then, the washing apparatus 1 may check whether the drum 40 arrives at the second target rotation speed (940). When the drum 40 does not yet arrive at the second target rotation speed, the washing apparatus 1 may repeatedly check this.

On the other hand, when the drum 40 arrives at the second target rotation speed, the washing apparatus 1 may constantly rotate the drum 40 at the second target rotation speed (950). Since the fact that the drum 40 arrives at the second target rotation speed means that the second section of the washing mode of the diaphragm 30 is terminated, the washing apparatus 1 may terminate the washing mode of the diaphragm 30 and may constantly rotate the drum 40.

According to one aspect of the washing apparatus and the control method for the same, the diaphragm can be washed using a conventional door washing nozzle without an addition of a new element.

According to another aspect of the washing apparatus and the control method for the same, the washing efficiency can be enhanced by installing the diaphragm washing nozzle at the position corresponding to the rotating direction of the drum.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing apparatus, comprising:

a main body having an entrance provided at a front side thereof;

a door configured to open and close the entrance;

a tub having an opening corresponding to the entrance and provided inside the main body;

a diaphragm configured to connect the entrance with the opening;

a drum rotatably provided inside the tub;

a door washing nozzle provided on the diaphragm to inject water to the door; and a controller configured to control the door washing nozzle to inject the water for a first time in a first section and then to inject the water for a second time in a second section when a washing mode of the diaphragm is entered, wherein the washing mode of the diaphragm includes the first section in which the drum in a stopped state is accelerated to arrive at a first target rotation speed and the second section in which the drum at the first target rotation speed is accelerated to arrive at a second target rotation speed, wherein the first target rotation speed is less than the second target rotation speed.

2. The washing apparatus according to claim 1, wherein the diaphragm includes a buffer provided to be bent and thus to reduce vibration generated by rotation of the drum from being transmitted to the main body, and the controller controls the door washing nozzle to provide the water to the buffer of the diaphragm.

3. The washing apparatus according to claim 1, further comprising a washing reinforcement nozzle provided on the diaphragm to inject the water into the drum, wherein the controller controls the washing reinforcement nozzle to inject the water when the door washing nozzle injects the water.

4. The washing apparatus according to claim 3, further comprising a water supply pipe configured to simultaneously supply the water to the door washing nozzle and the washing reinforcement nozzle, wherein the controller controls opening and closing of the water supply pipe so that the water supplied through the water supply pipe is injected through the door washing nozzle and the washing reinforcement nozzle.

5. The washing apparatus according to claim 1, wherein the controller controls the drum to be rotated with a first rotational acceleration in the first section and then to be rotated with a second rotational acceleration in the second section when the washing mode of the diaphragm is entered.

6. The washing apparatus according to claim 1, wherein the controller controls the drum to be constantly rotated for a third time when the drum arrives at the first target rotation speed.

7. The washing apparatus according to claim 1, further comprising an input part configured to receive a command for entering the washing mode of the diaphragm.

8. The washing apparatus according to claim 1, wherein the controller controls the washing apparatus to enter the washing mode of the diaphragm when the washing apparatus performs at least one of a rinsing stroke and a spin-drying stroke.

9. The washing apparatus according to claim 1, wherein the controller controls the door washing nozzle to inject the water for the first time when the drum is rotated at 300 RPM or more in the first section.

* * * * *